US006942601B2

(12) United States Patent
Chuang et al.

(10) Patent No.: US 6,942,601 B2
(45) Date of Patent: Sep. 13, 2005

(54) CASING STRUCTURE OF WRIST EXERCISER

(76) Inventors: Yun Yu Chuang, 4F, No. 16, Alley 15, Lane 82, Da Yong Street, San Chong City, Taipei (TW); Ming Hung Lin, 2F, No. 24, Lane 178, Li Shyng Road, Section 1, San Chong City, Taipei (TW)

( * ) Notice: Subject to any disclaimer, the term of this patent is extended or adjusted under 35 U.S.C. 154(b) by 456 days.

(21) Appl. No.: 10/119,006

(22) Filed: Apr. 10, 2002

(65) Prior Publication Data

US 2003/0100408 A1 May 29, 2003

(30) Foreign Application Priority Data

Nov. 23, 2001 (TW) ..... 90220341 U

(51) Int. Cl.[7] ..... A63B 23/16; A63B 21/22

(52) U.S. Cl. ..... 482/44; 482/49; 482/110

(58) Field of Search ..... 482/44–50, 110; 74/5 R; 473/594–595; 446/233–235

(56) References Cited

U.S. PATENT DOCUMENTS

| | | | | |
|---|---|---|---|---|
| 5,263,908 A | * | 11/1993 | Chen | 482/44 |
| 5,353,655 A | * | 10/1994 | Mishler | 74/5 R |
| 5,413,551 A | * | 5/1995 | Wu | 601/46 |
| 6,042,517 A | * | 3/2000 | Gunther et al. | 482/57 |
| 6,186,914 B1 | * | 2/2001 | Lin | 473/594 |
| 6,629,908 B2 | * | 10/2003 | Hamady | 482/45 |

* cited by examiner

*Primary Examiner*—Jerome W. Donnelly
*Assistant Examiner*—Fenn C. Mathew
(74) *Attorney, Agent, or Firm*—Rosenberg, Klein & Lee

(57) ABSTRACT

A wrist exercise includes a casing defining an interior space rotatably receiving a rotor. The casing includes upper and lower casing members. The upper casing member has a first mating edge forming a first mating device. The lower casing member has a second mating edge forming a second mating device for mating the first mating device to attach the lower casing member to the upper casing member whereby a circumferential groove is defined between the first and second mating edges. A first retention ring is at least partially fit over the upper and lower casing members and forms an inwardly-projecting portion fit into the groove to securely retain the upper and lower casing members in position.

1 Claim, 13 Drawing Sheets

CASING STRUCTURE OF WRIST EXERCISER

BACKGROUND OF THE INVENTION

1. Field of the Invention

The present invention generally relates to a wrist exerciser, and in particular to a separable casing structure of a wrist exerciser.

2. The Related Art

Wrist exercisers comprising a hollow casing inside which a spherical rotor is rotatably supported are known for exercising wrist-related muscles and rehabilitation purposes. Examples are shown in Taiwan Utility Model No. 135058 and U.S. Pat. No. 5,800,311. FIGS. 21 and 22 of the attached drawings show a conventional wrist exerciser, generally designated with reference numeral A. The wrist exerciser A comprises a spherical, hollow casing comprised of an upper hemispherical casing member A1 and a lower hemispherical casing member A2. The upper and lower casing members A1, A2 mate each other to form the casing in which a spherical rotor A3 is rotatably mounted. By rotating the casing to causes rotation of the rotor A3, a centrifugal force induced by the rotor A3 is applied to a user's palm for exercising the wrist-related muscles.

The casing members A1, A2 are fixedly attached to each other by means of for example ultrasonic welding whereby separation the casing members A1, A2 without damage to the casing itself is in general impossible. Under this circumstances, it is not possible for a general user to change any parts of the wrist exercise, including the casing members and the rotor, or doing any repairing of the rotor.

Furthermore, to be more attractive to the general users, some of the wrist exercisers include sound and light generators mounted in the rotor A3 whereby when the rotor rotates, colorful patterns of lights and sounds are generated. Some of the wrist exercisers include a counter for counting the turns of the rotor A3. All these devices are fixed inside the casing. There is in general no way for users to replace or change these devices.

Thus, it is desired to have a wrist exerciser having a separable casing for overcoming the above problems.

SUMMARY OF THE INVENTION

An object of the present invention is to provide a separable casing structure of a wrist exerciser that allows a user to open the casing for replacing parts of the wrist exerciser.

Another object of the present invention is to provide a wrist exerciser having a separable casing to allow a user to replace malfunctioning parts for repairing/maintenance purposes.

To achieve the above objects, in accordance with the present invention, there is provided a wrist exercise comprising a casing defining an interior space rotatably receiving a rotor. The casing includes upper and lower casing members. The upper casing member has a first mating edge forming a first mating device. The lower casing member has a second mating edge forming a second mating device for mating the first mating device to attach the lower casing member to the upper casing member whereby a circumferential groove is defined between the first and second mating edges. A first retention ring is at least partially fit over the upper and lower casing members and forms an inwardly-projecting portion fit into the groove to securely retain the upper and lower casing members in position.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
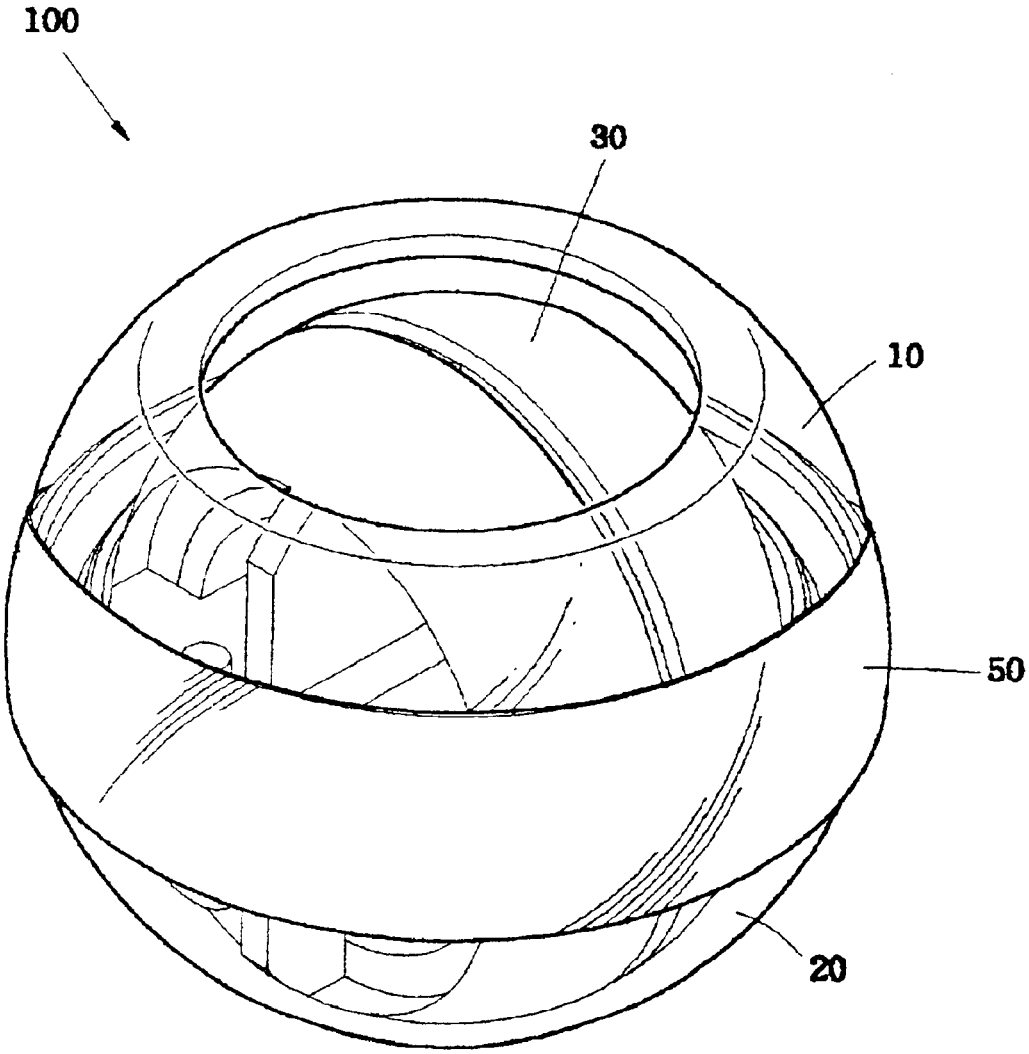
FIG. 1 is a perspective view of a wrist exerciser constructed in accordance with the present invention.

With reference to the drawings and in particular to FIG. 1, a wrist exerciser constructed in accordance with the present invention, generally designated with reference numeral 100, comprises a casing comprising upper and lower casing members 10, 20 mating each other to define an interior space (not labeled) therebetween. A spherical rotor 30 is rotatably supported and received in the interior space. An outer retention ring 50, preferably made of a resilient material, is at least partially fit over the upper and lower casing members 10, 20 to securely retain the casing members 10, 20 together.

Figure 2:
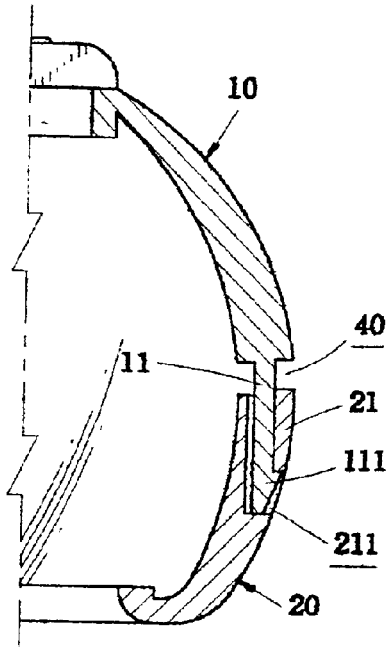
FIG. 2 is a partial cross-sectional view showing a casing of the wrist exerciser constructed in accordance with a first embodiment of the present invention.
Figure 3:
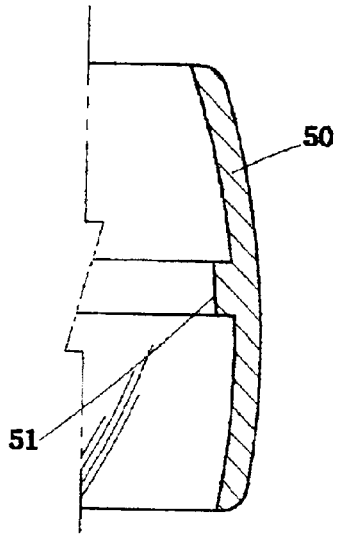
FIG. 3 is a cross-sectional view of an outer retention ring of the casing of the first embodiment of the present invention.

Also referring to FIGS. 2 and 3, wherein a casing constructed in accordance with a first embodiment of the present invention is shown, the casing comprises upper and lower casing members 10, 20 having generally hemispherical configurations mating each other along mating edges. The upper casing member 10 has first mating means 11 and the lower casing member 20 has second mating means 21 for engaging each other to attach the upper and lower casing members 10, 20 together. In the first embodiment illustrated in FIGS. 2 and 3, the first mating means 11 comprises a leg depending from the mating edge of the upper casing member 10 and forming a barb 111 at a remote end thereof. The second mating means 21 comprises an opening 211 for receivingly engaging the barb 111 of the first mating means 11 thereby attaching the casing members 10, 20 together. In this respect, a slot (not labeled) is defined along the mating edge of the lower casing member 20 for receiving the leg of the upper casing member 10. The opening 211 is in communication with the slot for receiving the barb 111. The leg is made resilient whereby by deflecting the leg to disengage the barb 111 from the opening 211, the upper casing member 10 is separated from the lower casing members 20.

The mating edge of the upper casing member 10 is spaced from the mating edge of the lower casing member 20 a distance, whereby a circumferential groove 40 is defined between the mating edges of the upper and lower casing members 10, 20. The outer retention ring 50, particularly shown in FIG. 3, has a concave configuration compliant to the configuration of the casing members 10, 20 for being at least partially fit over the upper and lower casing members 10, 20. A circumferential rib 51 is formed on an inside surface of the outer retention ring 50 and extending inward for being fit into the groove 40 between the casing members 10, 20. Preferably, the outer retention ring 50, at least the rib 51 thereof, is made of a resilient material whereby a tight fit can be formed between the rib 51 and the groove 40 for securely retaining the upper and lower casing members 10, 20 in position and attached to each other.

Figure 4:
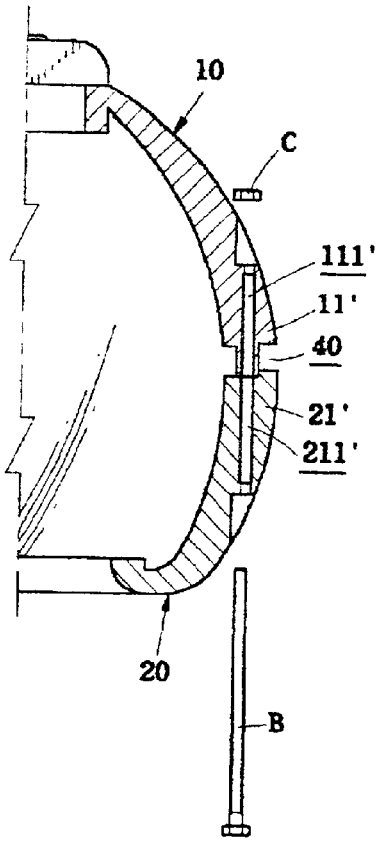
FIG. 4 is a partial cross-sectional view showing a casing constructed in accordance with a second embodiment of the present invention.
Figure 5:
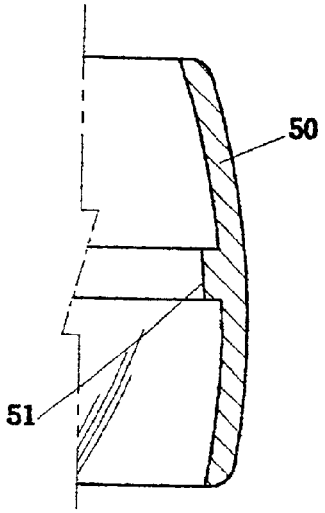
FIG. 5 is a cross-sectional view of an outer retention ring of the casing of the second embodiment.

Referring to FIGS. 4 and 5, wherein a casing constructed in accordance with a second embodiment of the present invention is shown, the casing comprises upper and lower casing members 10, 20 having generally hemispherical configurations mating each other along mating edges. The upper casing member 10 has first mating means 11' and the lower casing member 20 has second mating means 21' for engaging each other to attach the upper and lower casing members 10, 20 together. In the second embodiment illustrated in FIGS. 4 and 5, the first mating means 11' comprises a bore 111' defined in the upper casing member 10. The second mating means 21' comprises a bore 211' defined in the lower casing member 20. The bores 111', 211' are substantially and axially aligned with each other. A bolt B extends through the bores 111', 211' and engages a nut C to secure the upper and lower casing members 10, 20 together.

A projection (not labeled) extends from the mating edge of the upper casing member 10 and engaging the mating edge of the lower casing member 20 to space the mating edge of the upper casing member 10 from the mating edge of the lower casing member 20 a distance, whereby a circumferential groove 40 is defined between the mating edges of the upper and lower casing members 10, 20. The outer retention ring 50, particularly shown in FIG. 5, has a concave configuration compliant to the configuration of the casing members 10, 20 for being at least partially fit over the upper and lower casing members 10, 20. A circumferential rib 51 is formed on an inside surface of the outer retention ring 50 and extending inward for being fit into the groove 40 between the casing members 10, 20. Preferably, the outer retention ring 50, at least the rib 51 thereof, is made of a resilient material whereby a tight fit can be formed between the rib 51 and the groove 40 for securely retaining the upper and lower casing members 10, 20 in position and attached to each other.

Figure 6:
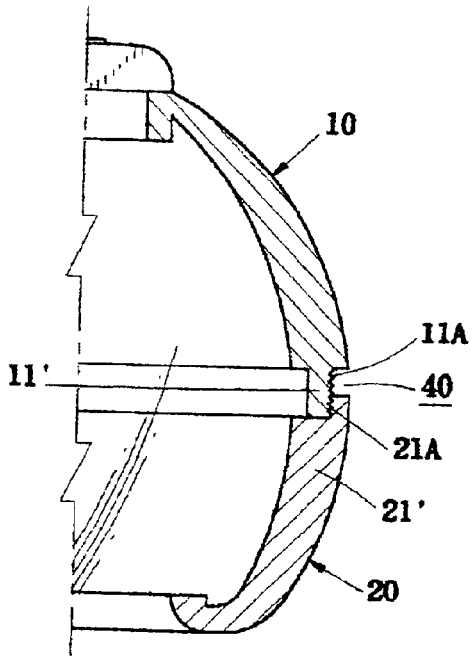
FIG. 6 is a partial cross-sectional view showing a casing constructed in accordance with a third embodiment of the present invention.
Figure 7:
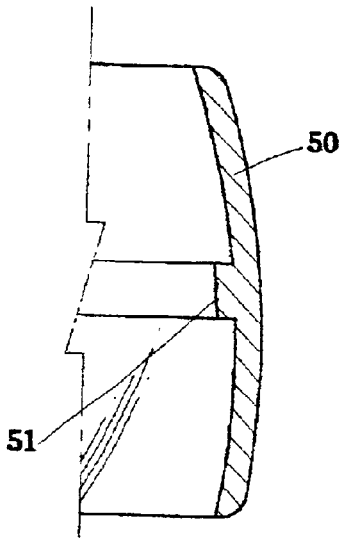
FIG. 7 is a cross-sectional view of an outer retention ring of the casing of the third embodiment.
Figure 8:
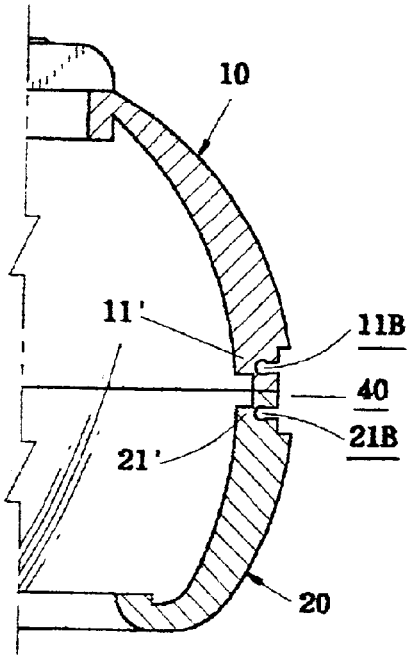
FIG. 8 is a partial cross-sectional view showing a casing constructed in accordance with a fourth embodiment of the present invention.
Figure 9:
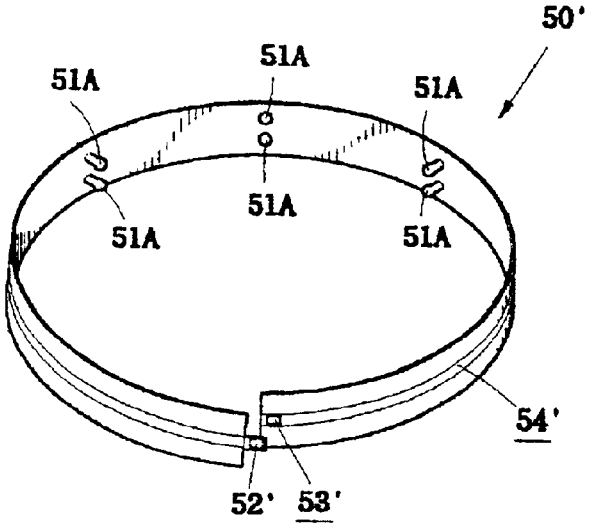
FIG. 9 is a perspective view of an inner retention ring of the casing of the fourth embodiment in an open condition.
Figure 10:
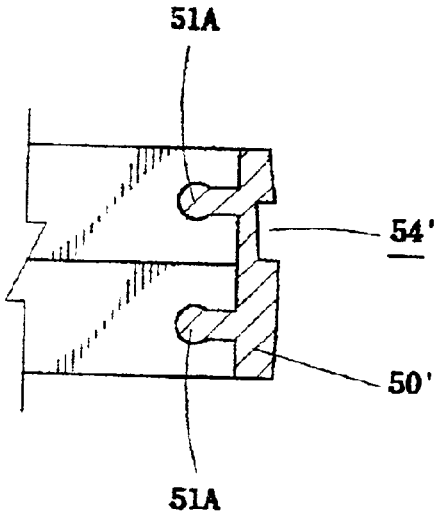
FIG. 10 is a cross-sectional view of the inner retention ring of the casing of the fourth embodiment.

Referring to FIGS. 6 and 7, wherein a casing constructed in accordance with a third embodiment of the present invention is shown, the casing comprises upper and lower casing members 10, 20 having generally hemi-spherical configurations mating each other along mating edges. The upper casing member 10 has first mating means 11' and the lower casing member 20 has second mating means 21' for engaging each other to attach the upper and lower casing members 10, 20 together. In the third embodiment illustrated in FIGS. 6 and 7, the first mating means 11' comprises a flange (not labeled) extending along the mating edge of the upper casing member 10 and having an outward-facing surface on which threading 11A is formed. The second mating means 21' comprises a flange (not labeled) extending along the mating edge of the lower casing member 20 and having an inward-facing surface on which threading 21A is formed. The threading 11A of the upper casing member 10 and the threading 21A of the lower casing member 20 engage each other to secure the upper and lower casing members 10, 20 together.

The flanges of the upper and lower casing members 10, 20 are dimensioned so that the engagement of the threading 11A, 21A makes the mating edge of the upper casing member 10 spaced from the mating edge of the lower casing member 20 a distance, whereby a circumferential groove 40 is defined between the mating edges of the upper and lower casing members 10, 20. The outer retention ring 50, particularly shown in FIG. 7, has a concave configuration compliant to the configuration of the casing members 10, 20 for being at least partially fit over the upper and lower casing members 10, 20. A circumferential rib 51 is formed on an inside surface of the outer retention ring 50 and extending inward for being fit into the groove 40 between the casing members 10, 20. Preferably, the outer retention ring 50, at least the rib 51 thereof, is made of a resilient material whereby a tight fit can be formed between the rib 51 and the groove 40 for securely retaining the upper and lower casing members 10, 20 in position and attached to each other.

Referring to FIGS. 8–11, wherein a casing constructed in accordance with a fourth embodiment of the present invention is shown, the casing comprises upper and lower casing members 10, 20 having generally hemispherical configurations mating each other along mating edges. The upper casing member 10 has first mating means 11' and the lower casing member 20 has second mating means 21' for engaging each other to attach the upper and lower casing members 10, 20 together. In the fourth embodiment illustrated in FIGS. 8–11, the first mating means 11' comprises a flange (not labeled) extending along the mating edge of the upper casing member 10 and the second mating means 21' comprises a flange (not labeled) extending along the mating edge of the lower casing member 20. The flanges of the upper and lower casing members 10, 20 are substantially symmetric to each other and overlappingly engaging each other whereby a circumferential groove 40 is defined between the mating edges of the upper and lower casing members 10, 20. A plurality of notches 11B is defined in and spaced along the flange of the upper casing member 10 and similar notches 21B are defined in and spaced along the flange of the lower casing member 20.

An inner retention ring 50' made of a length of resilient material has opposite ends. A projection 52' is formed on a first one of the ends and a cavity 53' is defined in a second one of the ends for receiving the projection 52' thereby fixing the ends together to form the ring. The inner retention ring 50' has an inner surface (not labeled) on which pairs of bosses 51A are formed for being tightly fit into the notches 11A, 21A of the upper and lower casing members 10, 20 to secure the upper and lower casing members 10, 20 together. The inner retention ring 50' has an opposite outer surface in which a circumferential groove 54' is defined. The inner retention ring 50' is sized to be substantially completely received in the groove 40 defined between the mating edges of the upper and lower casing members 10, 20.

Figure 11:
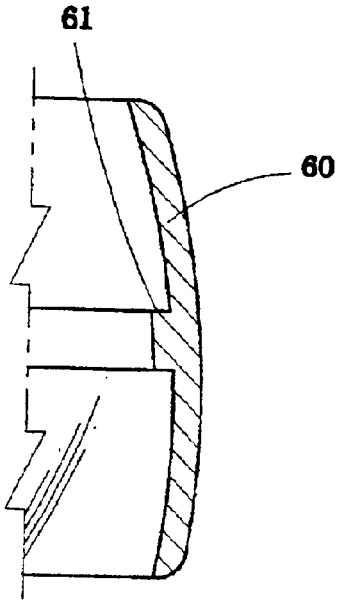
FIG. 11 is a cross-sectional view of an outer retention ring of the casing of the fourth embodiment.
Figure 12:
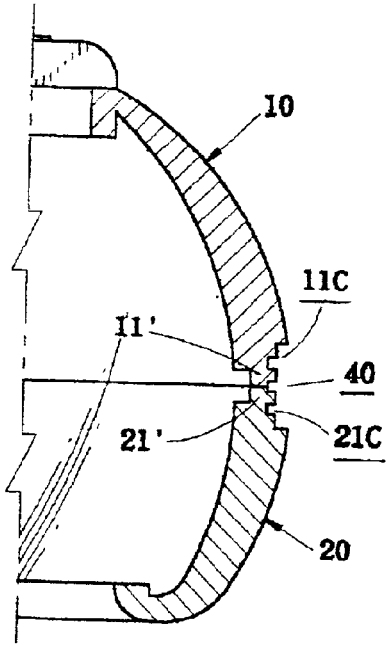
FIG. 12 is a partial cross-sectional view showing a casing constructed in accordance with a fifth embodiment of the present invention.
Figure 13:
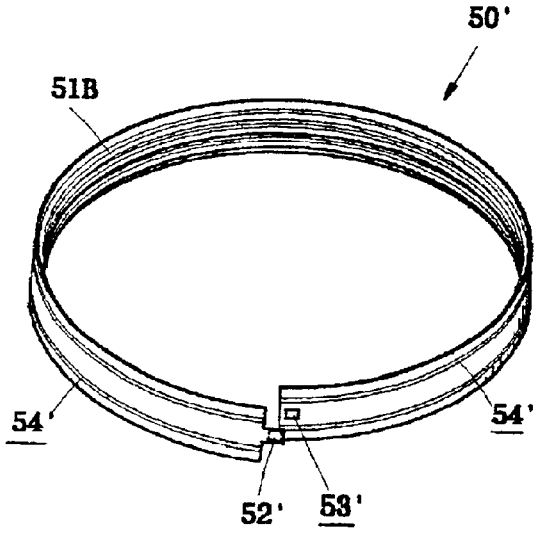
FIG. 13 is a perspective view of an inner retention ring of the casing of the fifth embodiment in an open condition.
Figure 14:
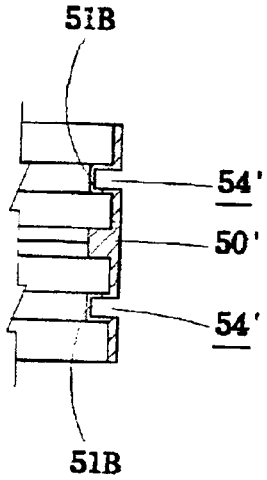
FIG. 14 is a cross-sectional view of the inner retention ring of the casing of the fifth embodiment.

An outer retention ring 60, particularly shown in FIG. 11, has a concave configuration compliant to the configuration of the casing members 10, 20 and the outer surface of the inner retention ring 50' for being at least partially fit over the upper and lower casing members 10, 20. A circumferential rib 61 is formed on an inside surface of the outer retention ring 60 and extending inward for being tightly fit into the groove 54' of the inner retention ring 50' whereby the upper and lower casing members 10, 20 are securely retained in position and attached to each other by the inner and outer retention rings 50', 60.

Referring to FIGS. 12–15, wherein a casing constructed in accordance with a fifth embodiment of the present invention is shown, the casing comprises upper and lower casing members 10, 20 having generally hemi-spherical configurations mating each other along mating edges. The upper casing member 10 has first mating means 11' and the lower casing member 20 has second mating means 21' for engaging each other to attach the upper and lower casing members 10, 20 together. In the fifth embodiment illustrated in FIGS. 12–15, the first mating means 11' comprises a flange (not labeled) extending along the mating edge of the upper casing member 10 and the second mating means 21' comprises a flange (not labeled) extending along the mating edge of the lower casing member 20. The flanges of the upper and lower casing members 10, 20 are substantially symmetric to each other and overlappingly engaging each other whereby a circumferential groove 40 is defined between the mating edges of the upper and lower casing members 10, 20. At least one circumferential groove 11C is defined in and co-extensive with the flange of the upper casing member 10 and similarly at least one circumferential groove 21C is defined in and co-extensive with the flange of the lower casing member 20.

An inner retention ring 50' made of a length of resilient material has opposite ends. A projection 52' is formed on a first one of the ends and a cavity 53' is defined in a second one of the ends for receiving the projection 52' thereby fixing the ends together to form the ring. The inner retention ring 50' has an inner surface (not labeled) on which circumferential ribs 51B are formed for being tightly fit into the grooves 11C, 21C notches 11A, 21A of the upper and lower casing members 10, 20 to secure the upper and lower casing members 10, 20 together. The inner retention ring 50' has an opposite outer surface in which a plurality of circumferential grooves 54' is defined. The inner retention ring 50' is sized to be substantially completely received in the groove 40 defined between the mating edges of the upper and lower casing members 10, 20.

Figure 15:
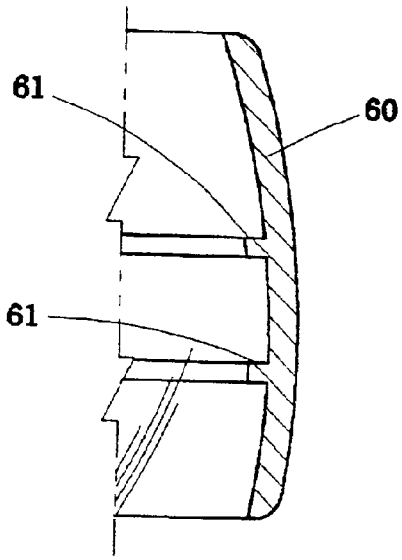
FIG. 15 is a cross-sectional view of an outer retention ring of the casing of the fifth embodiment.
Figure 16:
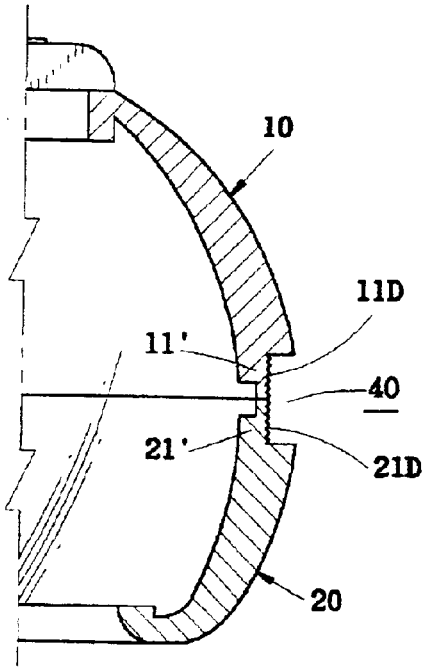
FIG. 16 is a partial cross-sectional view showing a casing constructed in accordance with a sixth embodiment of the present invention.
Figure 17:
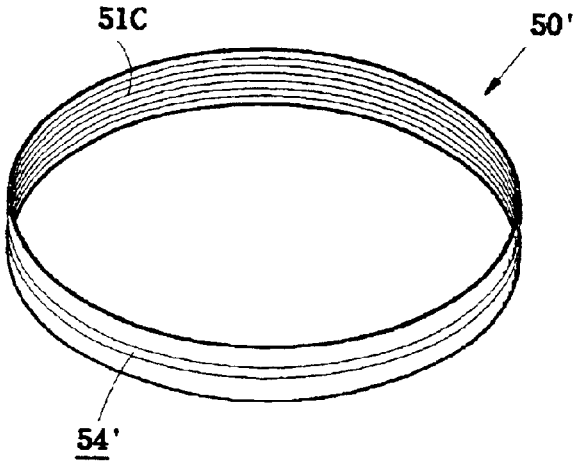
FIG. 17 is a perspective view of an inner retention ring of the casing of the sixth embodiment.
Figure 18:
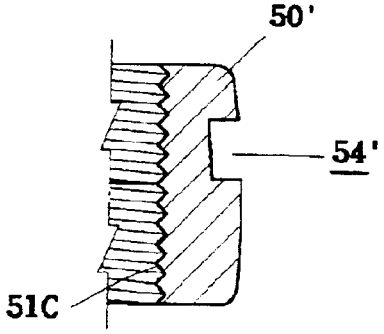
FIG. 18 is a cross-sectional view of the inner retention ring of the casing of the sixth embodiment.

An outer retention ring 60, particularly shown in FIG. 15, has a concave configuration compliant to the configuration of the casing members 10, 20 and the outer surface of the inner retention ring 50' for being at least partially fit over the upper and lower casing members 10, 20. Circumferential ribs 61 are formed on an inside surface of the outer retention ring 60 and extending inward for being tightly fit into the grooves 54' of the inner retention ring 50' whereby the upper and lower casing members 10, 20 are securely retained in position and attached to each other by the inner and outer retention rings 50', 60.

Referring to FIGS. 16–19, wherein a casing constructed in accordance with a sixth embodiment of the present invention is shown, the casing comprises upper and lower casing members 10, 20 having generally hemi-spherical configurations mating each other along mating edges. The upper casing member 10 has first mating means 11' and the lower casing member 20 has second mating means 21' for engaging each other to attach the upper and lower casing members 10, 20 together. In the sixth embodiment illustrated in FIGS. 16–19, the first mating means 11' comprises a flange (not labeled) extending along the mating edge of the upper casing member 10 and the second mating means 21' comprises a flange (not labeled) extending along the mating edge of the lower casing member 20. The flanges of the upper and lower casing members 10, 20 are substantially symmetric to each other and overlappingly engaging each other whereby a circumferential groove 40 is defined between the mating edges of the upper and lower casing members 10, 20. Circumferential serration 11D is formed in and co-extensive with the flange of the upper casing member 10 and similar serration 21D is formed in and co-extensive with the flange of the lower casing member 20.

An inner retention ring 50' made of resilient materials has an inner surface (not labeled) on which serration 51C complementary to the serrations 11D, 21D of the casing members 10, 20 is formed for matingly engaging the serrations 11D, 21D thereby securing the upper and lower casing members 10, 20 together. The inner retention ring 50' has an opposite outer surface in which a circumferential groove 54' is defined. The inner retention ring 50' is sized to be substantially completely received in the groove 40 defined between the mating edges of the upper and lower casing members 10, 20.

Figure 19:
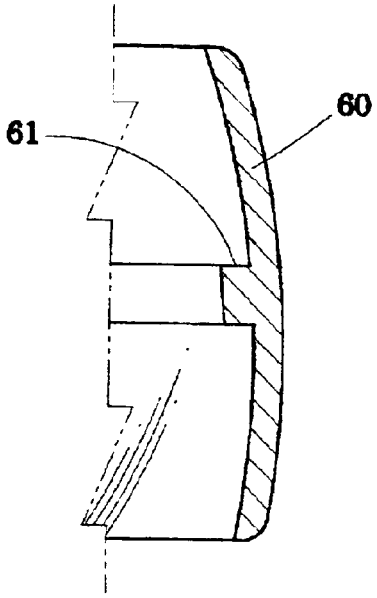
FIG. 19 is a cross-sectional view of an outer retention ring of the casing of the sixth embodiment.

An outer retention ring 60, particularly shown in FIG. 19, has a concave configuration compliant to the configuration of the casing members 10, 20 and the outer surface of the inner retention ring 50' for being at least partially fit over the upper and lower casing members 10, 20. A circumferential rib 61 is formed on an inside surface of the outer retention ring 60 and extending inward for being tightly fit into the groove 54' of the inner retention ring 50' whereby the upper and lower casing members 10, 20 are securely retained in position and attached to each other by the inner and outer retention rings 50', 60.

Figure 20:
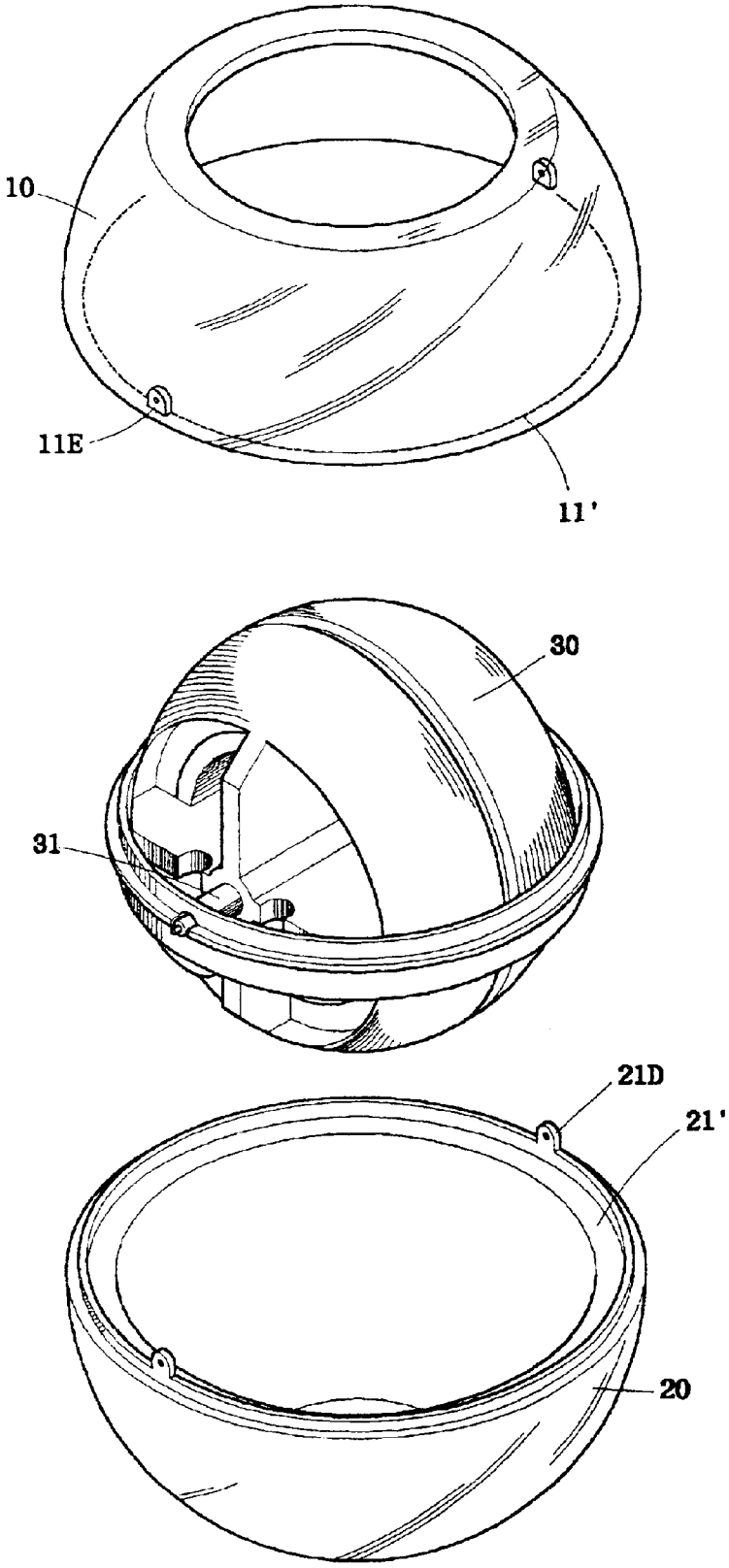
FIG. 20 is an exploded view of a wrist exerciser comprising a casing constructed in accordance with a seventh embodiment of the present invention.
Figure 21:
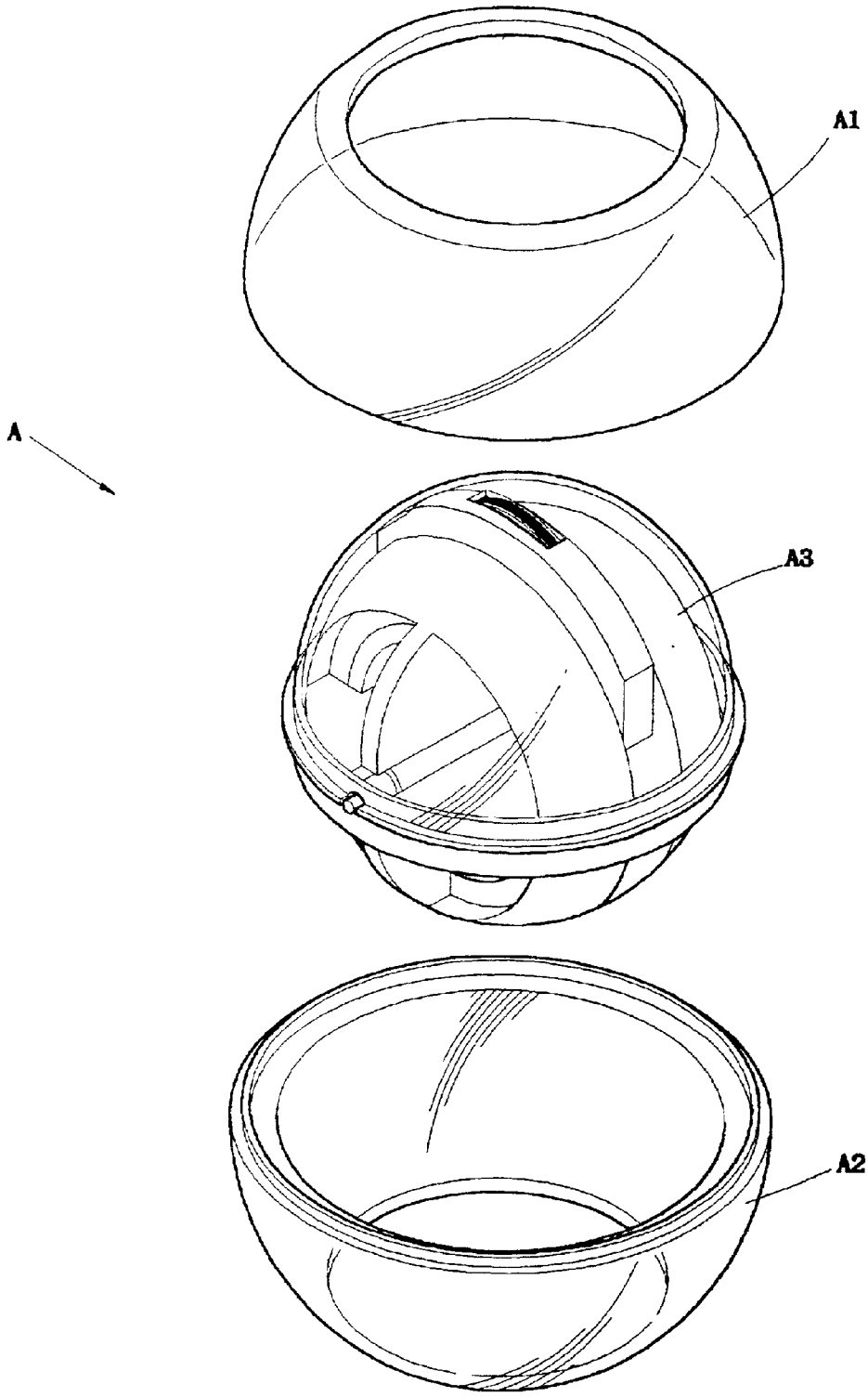
FIG.21 PRIOR ART
FIG. 21 is an exploded view of a conventional wrist exerciser.
Figure 22:
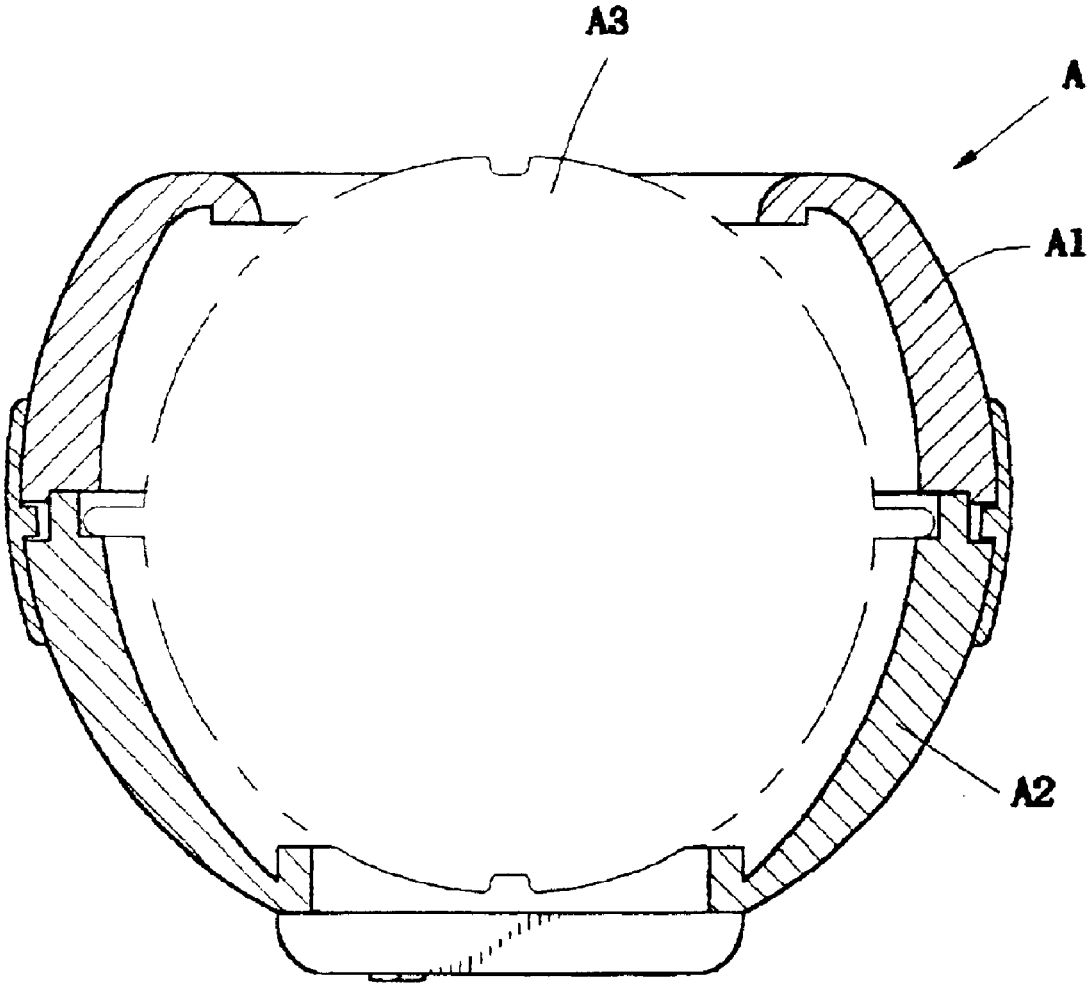
FIG.22 PRIOR ART
FIG. 22 is a cross-sectional view of the conventional wrist exerciser.

FIG. 20 shows an exploded view of a wrist exerciser having a casing constructed in accordance with a seventh embodiment of the present invention. The casing comprises upper and lower casing members 10, 20 having generally hemi-spherical configurations mating each other along mating edges. The upper casing member 10 has first mating means 11' and the lower casing member 20 has second mating means 21' for engaging each other to attach the upper and lower casing members 10, 20 together. The first mating means 11' comprises a flange (not labeled) extending along the mating edge of the upper casing member 10 and the second mating means 21' comprises a flange (not labeled) extending along the mating edge of the lower casing member 20. The flanges of the upper and lower casing members 10, 20 overlap each other. Lugs 11E defining aligned holes (not labeled) are formed on the flange of the upper casing member 10. Lug 21D corresponding to the lugs 11E and defining holes (not labeled) are formed on the flange of the lower casing member 20. The lugs 11E, 21D substantially overlap each other when the casing members 10, 20 are mounted together. The rotor 30 has a central shaft 31 having opposite ends extending through the holes of the overlapped lugs 11E, 21D to secure the casing members 10, 20 together.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. In a wrist exercise comprising a casing defining an interior space rotatably receiving a rotor, the casing comprising:

an upper casing member having a first mating edge on which first mating means is formed;

a lower casing member having a second mating edge on which second mating means is formed to mate the first mating means for attaching the lower casing member to the upper casing member whereby a circumferential groove is defined between the first and second mating edges, the first mating means including a flange extending along the first mating edge and having an outward-facing surface on which a first threading is formed, the second mating means including a flange extending along the second mating edge and having an inward-facing surface on which a second threading is formed, the first and second threading engaging each other to secure the upper and lower casing member together; and a first retention ring at least partially fit over the upper and lower casing member, the first retention ring having an inwardly-projecting portion fit into the groove.

* * * * *